US007604054B2

(12) United States Patent
Hocking

(10) Patent No.: US 7,604,054 B2
(45) Date of Patent: Oct. 20, 2009

(54) ENHANCED HYDROCARBON RECOVERY BY CONVECTIVE HEATING OF OIL SAND FORMATIONS

(75) Inventor: Grant Hocking, Alpharetta, GA (US)

(73) Assignee: GeoSierra LLC, Alpharetta, GA (US)

( * ) Notice: Subject to any disclaimer, the term of this patent is extended or adjusted under 35 U.S.C. 154(b) by 0 days.

(21) Appl. No.: 11/626,092

(22) Filed: Jan. 23, 2007

(65) Prior Publication Data

US 2007/0199707 A1 Aug. 30, 2007

Related U.S. Application Data

(63) Continuation-in-part of application No. 11/379,829, filed on Apr. 24, 2006, now abandoned, and a continuation-in-part of application No. 11/379,123, filed on Apr. 18, 2006, now abandoned, and a continuation-in-part of application No. 11/278,470, filed on Apr. 3, 2006, now abandoned, and a continuation-in-part of application No. 11/277,789, filed on Mar. 29, 2006, now abandoned, and a continuation-in-part of application No. 11/277,815, filed on Mar. 29, 2006, now abandoned, and a continuation-in-part of application No. 11/277,775, filed on Mar. 29, 2006, now abandoned, and a continuation-in-part of application No. 11/277,308, filed on Mar. 23, 2006, now abandoned, and a continuation-in-part of application No. 11/363,540, filed on Feb. 27, 2006.

(51) Int. Cl.
*E21B 36/00* (2006.01)
*E21B 43/24* (2006.01)

(52) U.S. Cl. ..... 166/302; 166/57; 166/280.1; 166/59; 166/60

(58) Field of Classification Search ..... 166/59, 166/60, 61
See application file for complete search history.

(56) References Cited

U.S. PATENT DOCUMENTS 1,789,993 A 1/1931 Switzer
2,178,554 A 11/1939 Bowie (Continued)

*Primary Examiner*—Zakiya W Bates
*Assistant Examiner*—Angela M DiTrani
(74) *Attorney, Agent, or Firm*—Smith, Gambrell & Russell

(57) ABSTRACT

The present invention involves a method and apparatus for enhanced recovery of petroleum fluids from the subsurface by convective heating of the oil sand formation and the heavy oil and bitumen in situ by a downhole electric heater. Multiple propped vertical hydraulic fractures are constructed from the well bore into the oil sand formation and filled with a diluent. The heater and downhole pump force thermal convective flow of the heated diluent to flow upward and outward into the propped fractures and circulating back down and back towards the well bore heating the oil sands and in situ bitumen on the vertical faces of the propped fractures. The diluent now mixed with produced products from the oil sand re-enters the bottom of the well bore and passes over the heater element and is reheated to continue to flow in the convective cell. Thus the heating and diluting of the in place bitumen occurs predominantly circumferentially, i.e. orthogonal to the propped fracture, by diffusion from the propped vertical fracture faces progressing at a nearly uniform rate into the oil sand deposit. In situ hydrogenation and thermal cracking of the in place bitumen can provide a higher grade produced product. The heated low viscosity oil is produced through the well bore at the completion of the active heating phase of the process.

73 Claims, 7 Drawing Sheets

U.S. PATENT DOCUMENTS 2,548,360 A 4/1951 Germain
2,634,961 A 4/1953 Ljungström
2,732,195 A 1/1956 Ljungström
2,780,450 A 2/1957 Ljungström
3,059,909 A 10/1962 Wise
3,062,282 A * 11/1962 Schleicher ..... 166/245
3,225,828 A 12/1965 Wisenbaker
3,301,723 A 1/1967 Chrisp
3,349,847 A 10/1967 Smith et al.
3,739,852 A 6/1973 Woods et al.
3,888,312 A 6/1975 Tiner et al.
3,994,340 A 11/1976 Anderson et al.
4,085,803 A 4/1978 Butler
4,099,570 A 7/1978 Vandergrift
4,116,275 A 9/1978 Butler et al.
4,119,151 A 10/1978 Smith
4,271,696 A 6/1981 Wood
4,280,559 A 7/1981 Best
4,344,485 A 8/1982 Butler
4,418,752 A * 12/1983 Boyer et al. ..... 166/267
4,450,913 A 5/1984 Allen et al.
4,454,916 A 6/1984 Shu
4,474,237 A 10/1984 Shu
4,513,819 A 4/1985 Islip et al.
4,519,454 A 5/1985 McMillen
4,566,536 A 1/1986 Holmes
4,597,441 A 7/1986 Ware et al.
4,598,770 A 7/1986 Shu et al.
4,625,800 A 12/1986 Venkatesan
4,696,345 A 9/1987 Hsueh
4,697,642 A 10/1987 Vogel
4,706,751 A 11/1987 Gondouin
4,716,960 A 1/1988 Eastlund et al.
4,926,941 A 5/1990 Glandt et al.
4,993,490 A 2/1991 Stephens et al.
5,002,431 A 3/1991 Heymans
5,046,559 A 9/1991 Glandt
5,054,551 A 10/1991 Duerksen
5,060,287 A 10/1991 Van Egmond
5,060,726 A 10/1991 Glandt et al.
5,065,818 A 11/1991 Van Egmond
5,103,911 A 4/1992 Heijnen
5,145,003 A * 9/1992 Duerksen ..... 166/272.3
5,211,230 A 5/1993 Ostapovich et al.
5,215,146 A 6/1993 Sanchez
5,255,742 A 10/1993 Mikus
5,273,111 A 12/1993 Brannan et al.
5,297,626 A 3/1994 Vinegar et al.
5,335,724 A 8/1994 Venditto
5,339,897 A 8/1994 Leaute
5,372,195 A 12/1994 Swanson
5,392,854 A 2/1995 Vinegar et al.
5,404,952 A * 4/1995 Vinegar et al. ..... 166/303
5,407,009 A 4/1995 Butler et al.
5,431,224 A 7/1995 Laali
5,472,049 A 12/1995 Chaffee
5,556,832 A * 9/1996 Van Slyke ..... 507/203
5,607,016 A 3/1997 Butler
5,626,191 A 5/1997 Greaves et al.
5,824,214 A 10/1998 Paul et al.
5,862,858 A 1/1999 Wellington et al.
5,871,637 A 2/1999 Brons
5,899,269 A 5/1999 Wellington et al.
5,899,274 A 5/1999 Frauenfeld et al.
5,954,946 A 9/1999 Klazinga et al.
6,023,554 A 2/2000 Vinegar et al.
6,056,057 A 5/2000 Vinegar et al.
6,076,046 A 6/2000 Vasudevan
6,079,499 A 6/2000 Mikus et al.
6,216,783 B1 4/2001 Hocking et al.
6,318,464 B1 11/2001 Mokrys
6,360,819 B1 3/2002 Vinegar
6,372,678 B1 * 4/2002 Youngman et al. ..... 501/128
6,412,557 B1 7/2002 Ayasse et al.
6,443,227 B1 * 9/2002 Hocking et al. ..... 166/250.1
6,591,908 B2 7/2003 Nasr
6,708,759 B2 3/2004 Leaute et al.
6,722,431 B2 4/2004 Karanikas et al.
6,769,486 B2 8/2004 Lim et al.
6,883,607 B2 4/2005 Nenniger et al.
6,991,037 B2 1/2006 Hocking
2005/0145387 A1 * 7/2005 Hocking ..... 166/308.1

* cited by examiner

ENHANCED HYDROCARBON RECOVERY BY CONVECTIVE HEATING OF OIL SAND FORMATIONS

RELATED APPLICATION

This application is a continuation-in-part of U.S. patent application Ser. No. 11/363,540, filed Feb. 27, 2006, U.S. patent application Ser. No. 11/277,308, filed Mar. 23, 2006 now abandoned, U.S. patent application Ser. No. 11/277,775, filed Mar. 29, 2006 now abandoned, U.S. patent application Ser. No. 11/277,815, filed Mar. 29, 2006 now abandoned, U.S. patent application Ser. No. 11/277,789, filed Mar. 29, 2006 now abandoned, U.S. patent application Ser. No. 11/278,470, filed Apr. 3, 2006 now abanboned, U.S. patent application Ser. No. 11/379,123, filed Apr. 18, 2006 now abandoned, and U.S. patent application Ser. No. 11/379,829, filed Apr. 24, 2006 now abandoned.

TECHNICAL FIELD

The present invention generally relates to enhanced recovery of petroleum fluids from the subsurface by convective heating of the oil sand formation and the viscous heavy oil and bitumen in situ, more particularly to a method and apparatus to extract a particular fraction of the in situ hydrocarbon reserve by controlling the reservoir temperature and pressure, while also minimizing water inflow into the heated zone and well bore, resulting in increased production of petroleum fluids from the subsurface formation.

BACKGROUND OF THE INVENTION

Heavy oil and bitumen oil sands are abundant in reservoirs in many parts of the world such as those in Alberta, Canada, Utah and California in the United States, the Orinoco Belt of Venezuela, Indonesia, China and Russia. The hydrocarbon reserves of the oil sand deposit is extremely large in the trillions of barrels, with recoverable reserves estimated by current technology in the 300 billion barrels for Alberta, Canada and a similar recoverable reserve for Venezuela. These vast heavy oil (defined as the liquid petroleum resource of less than 20° API gravity) deposits are found largely in unconsolidated sandstones, being high porosity permeable cohesionless sands with minimal grain to grain cementation. The hydrocarbons are extracted from the oils sands either by mining or in situ methods.

The heavy oil and bitumen in the oil sand deposits have high viscosity at reservoir temperatures and pressures. While some distinctions have arisen between tar and oil sands, bitumen and heavy oil, these terms will be used interchangeably herein. The oil sand deposits in Alberta, Canada extend over many square miles and vary in thickness up to hundreds of feet thick. Although some of these deposits lie close to the surface and are suitable for surface mining, the majority of the deposits are at depth ranging from a shallow depth of 150 feet down to several thousands of feet below ground surface. The oil sands located at these depths constitute some of the world's largest presently known petroleum deposits. The oil sands contain a viscous hydrocarbon material, commonly referred to as bitumen, in an amount that ranges up to 15% by weight. Bitumen is effectively immobile at typical reservoir temperatures. For example at 15° C., bitumen has a viscosity of ~1,000,000 centipoise. However, at elevated temperatures the bitumen viscosity changes considerably to ~350 centipoise at 100° C. down to ~10 centipoise at 180° C. The oil sand deposits have an inherently high permeability ranging from ~1 to 10 Darcy, thus upon heating, the heavy oil becomes mobile and can easily drain from the deposit.

Solvents applied to the bitumen soften the bitumen and reduce its viscosity and provide a non-thermal mechanism to improve the bitumen mobility. Hydrocarbon solvents consist of vaporized light hydrocarbons such as ethane, propane, or butane or liquid solvents such as pipeline diluents, natural condensate streams, or fractions of synthetic crudes. The diluent can be added to steam and flashed to a vapor state or be maintained as a liquid at elevated temperature and pressure, depending on the particular diluent composition. While in contact with the bitumen, the saturated solvent vapor dissolves into the bitumen. This diffusion process is due to the partial pressure difference between the saturated solvent vapor and the bitumen. As a result of the diffusion of the solvent into the bitumen, the oil in the bitumen becomes diluted and mobile and will flow under gravity. The resultant mobile oil may be deasphalted by the condensed solvent, leaving the heavy asphaltenes behind within the oil sand pore space with little loss of inherent fluid mobility in the oil sands due to the small weight percent (5-15%) of the asphaltene fraction to the original oil in place. Deasphalting the oil from the oil sands produces a high grade quality product by 3°-5° API gravity. If the reservoir temperature is elevated the diffusion rate of the solvent into the bitumen is raised considerably being two orders of magnitude greater at 100° C. compared to ambient reservoir temperatures of ~15° C.

In situ methods of hydrocarbon extraction from the oil sands consist of cold production, in which the less viscous petroleum fluids are extracted from vertical and horizontal wells with sand exclusion screens, CHOPS (cold heavy oil production system) cold production with sand extraction from vertical and horizontal wells with large diameter perforations thus encouraging sand to flow into the well bore, CSS (cyclic steam stimulation) a huff and puff cyclic steam injection system with gravity drainage of heated petroleum fluids using vertical and horizontal wells, stream flood using injector wells for steam injection and producer wells on 5 and 9 point layout for vertical wells and combinations of vertical and horizontal wells, SAGD (steam assisted gravity drainage) steam injection and gravity production of heated hydrocarbons using two horizontal wells, VAPEX (vapor assisted petroleum extraction) solvent vapor injection and gravity production of diluted hydrocarbons using horizontal wells, and combinations of these methods.

Cyclic steam stimulation and steam flood hydrocarbon enhanced recovery methods have been utilized worldwide, beginning in 1956 with the discovery of CSS, huff and puff or steam-soak in Mene Grande field in Venezuela and for steam flood in the early 1960s in the Kern River field in California. These steam assisted hydrocarbon recovery methods including a combination of steam and solvent are described, see U.S. Pat. No. 3,739,852 to Woods et al, U.S. Pat. No. 4,280,559 to Best, U.S. Pat. No. 4,519,454 to McMillen, U.S. Pat. No. 4,697,642 to Vogel, and U.S. Pat. No. 6,708,759 to Leaute et al. The CSS process raises the steam injection pressure above the formation fracturing pressure to create fractures within the formation and enhance the surface area access of the steam to the bitumen. Successive steam injection cycles reenter earlier created fractures and thus the process becomes less efficient over time. CSS is generally practiced in vertical wells, but systems are operational in horizontal wells, but have complications due to localized fracturing and steam entry and the lack of steam flow control along the long length of the horizontal well bore.

Descriptions of the SAGD process and modifications are described, see U.S. Pat. No. 4,344,485 to Butler, and U.S. Pat.

No. 5,215,146 to Sanchez and thermal extraction methods in U.S. Pat. No. 4,085,803 to Butler, U.S. Pat. No. 4,099,570 to Vandergrift, and U.S. Pat. No. 4,116,275 to Butler et al. The SAGD process consists of two horizontal wells at the bottom of the hydrocarbon formation, with the injector well located approximately 10-15 feet vertically above the producer well. The steam injection pressures exceed the formation fracturing pressure in order to establish connection between the two wells and develop a steam chamber in the oil sand formation. Similar to CSS, the SAGD method has complications, albeit less severe than CSS, due to the lack of steam flow control along the long section of the horizontal well and the difficulty of controlling the growth of the steam chamber.

A thermal steam extraction process referred to a HASDrive (heated annulus steam drive) and modifications thereof are described to heat and hydrogenate the heavy oils in situ in the presence of a metal catalyst, see U.S. Pat. No. 3,994,340 to Anderson et al, U.S. Pat. No. 4,696,345 to Hsueh, U.S. Pat. No. 4,706,751 to Gondouin, U.S. Pat. No. 5,054,551 to Duerksen, and U.S. Pat. No. 5,145,003 to Duerksen. It is disclosed that at elevated temperature and pressure the injection of hydrogen or a combination of hydrogen and carbon monoxide to the heavy oil in situ in the presence of a metal catalyst will hydrogenate and thermal crack at least a portion of the petroleum in the formation.

Thermal recovery processes using steam require large amounts of energy to produce the steam, using either natural gas or heavy fractions of produced synthetic crude. Burning these fuels generates significant quantities of greenhouse gases, such as carbon dioxide. Also, the steam process uses considerable quantities of water, which even though may be reprocessed, involves recycling costs and energy use. Therefore a less energy intensive oil recovery process is desirable.

Solvent assisted recovery of hydrocarbons in continuous and cyclic modes are described including the VAPEX process and combinations of steam and solvent plus heat, see U.S. Pat. No. 4,450,913 to Allen et al, U.S. Pat. No. 4,513,819 to Islip et al, U.S. Pat. No. 5,407,009 to Butler et al, U.S. Pat. No. 5,607,016 to Butler, U.S. Pat. No. 5,899,274 to Frauenfeld et al, U.S. Pat. No. 6,318,464 to Mokrys, U.S. Pat. No. 6,769,486 to Lim et al, and U.S. Pat. No. 6,883,607 to Nenniger et al. The VAPEX process generally consists of two horizontal wells in a similar configuration to SAGD; however, there are variations to this including spaced horizontal wells and a combination of horizontal and vertical wells. The startup phase for the VAPEX process can be lengthy and take many months to develop a controlled connection between the two wells and avoid premature short circuiting between the injector and producer. The VAPEX process with horizontal wells has similar issues to CSS and SAGD in horizontal wells, due to the lack of solvent flow control along the long horizontal well bore, which can lead to non-uniformity of the vapor chamber development and growth along the horizontal well bore.

Direct heating and electrical heating methods for enhanced recovery of hydrocarbons from oil sands have been disclosed in combination with steam, hydrogen, catalysts and/or solvent injection at temperatures to ensure the petroleum fluids gravity drain from the formation and at significantly higher temperatures (300° to 400° range and above) to pyrolysis the oil sands. See U.S. Pat. No. 2,780,450 to Ljungström, U.S. Pat. No. 4,597,441 to Ware et al, U.S. Pat. No. 4,926,941 to Glandt et al, U.S. Pat. No. 5,046,559 to Glandt, U.S. Pat. No. 5,060,726 to Glandt et al, U.S. Pat. No. 5,297,626 to Vinegar et al, U.S. Pat. No. 5,392,854 to Vinegar et al, and U.S. Pat. No. 6,722,431 to Karanikas et al. In situ combustion processes have also been disclosed see U.S. Pat. No. 5,211,230 to Ostapovich et al, U.S. Pat. No. 5,339,897 to Leaute, U.S. Pat. No. 5,413,224 to Laali, and U.S. Pat. No. 5,954,946 to Klazinga et al.

In situ processes involving downhole heaters are described in U.S. Pat. No. 2,634,961 to Ljungström, U.S. Pat. No. 2,732,195 to Ljungström, U.S. Pat. No. 2,780,450 to Ljungström. Electrical heaters are described for heating viscous oils in the forms of downhole heaters and electrical heating of tubing and/or casing, see U.S. Pat. No. 2,548,360 to Germain, U.S. Pat. No. 4,716,960 to Eastlund et al, U.S. Pat. No. 5,060,287 to Van Egmond, U.S. Pat. No. 5,065,818 to Van Egmond, U.S. Pat. No. 6,023,554 to Vinegar and U.S. Pat. No. 6,360,819 to Vinegar. Flameless downhole combustor heaters are described, see U.S. Pat. No. 5,255,742 to Mikus, U.S. Pat. No. 5,404,952 to Vinegar et al, U.S. Pat. No. 5,862,858 to Wellington et al, and U.S. Pat. No. 5,899,269 to Wellington et al. Surface fired heaters or surface burners may be used to heat a heat transferring fluid pumped downhole to heat the formation as described in U.S. Pat. No. 6,056,057 to Vinegar et al and U.S. Pat. No. 6,079,499 to Mikus et al.

The thermal and solvent methods of enhanced oil recovery from oil sands, all suffer from a lack of surface area access to the in place bitumen. Thus the reasons for raising steam pressures above the fracturing pressure in CSS and during steam chamber development in SAGD, are to increase surface area of the steam with the in place bitumen. Similarly the VAPEX process is limited by the available surface area to the in place bitumen, because the diffusion process at this contact controls the rate of softening of the bitumen. Likewise during steam chamber growth in the SAGD process the contact surface area with the in place bitumen is virtually a constant, thus limiting the rate of heating of the bitumen. Therefore both methods (heat and solvent) or a combination thereof would greatly benefit from a substantial increase in contact surface area with the in place bitumen. Hydraulic fracturing of low permeable reservoirs has been used to increase the efficiency of such processes and CSS methods involving fracturing are described in U.S. Pat. No. 3,739,852 to Woods et al, U.S. Pat. No. 5,297,626 to Vinegar et al, and U.S. Pat. No. 5,392,854 to Vinegar et al. Also during initiation of the SAGD process over pressurized conditions are usually imposed to accelerated the steam chamber development, followed by a prolonged period of under pressurized condition to reduce the steam to oil ratio. Maintaining reservoir pressure during heating of the oil sands has the significant benefit of minimizing water inflow to the heated zone and to the well bore.

Hydraulic fracturing of petroleum recovery wells enhances the extraction of fluids from low permeable formations due to the high permeability of the induced fracture and the size and extent of the fracture. A single hydraulic fracture from a well bore results in increased yield of extracted fluids from the formation. Hydraulic fracturing of highly permeable unconsolidated formations has enabled higher yield of extracted fluids from the formation and also reduced the inflow of formation sediments into the well bore. Typically the well casing is cemented into the borehole, and the casing perforated with shots of generally 0.5 inches in diameter over the depth interval to be fractured. The formation is hydraulically fractured by injecting fracture fluid into the casing, through the perforations and into the formation. The hydraulic connectivity of the hydraulic fracture or fractures formed in the formation may be poorly connected to the well bore due to restrictions and damage due to the perforations. Creating a hydraulic fracture in the formation that is well connected hydraulically to the well bore will increase the yield from the well, result in less inflow of formation sediments into the well bore and result in greater recovery of the petroleum reserves from the formation.

Turning now to the prior art, hydraulic fracturing of subsurface earth formations to stimulate production of hydrocarbon fluids from subterranean formations has been carried out in many parts of the world for over fifty years. The earth is hydraulically fractured either through perforations in a cased well bore or in an isolated section of an open bore hole. The horizontal and vertical orientation of the hydraulic fracture is controlled by the compressive stress regime in the earth and the fabric of the formation. It is well known in the art of rock mechanics that a fracture will occur in a plane perpendicular to the direction of the minimum stress, see U.S. Pat. No. 4,271,696 to Wood. At significant depth, one of the horizontal stresses is generally at a minimum, resulting in a vertical fracture formed by the hydraulic fracturing process. It is also well known in the art that the azimuth of the vertical fracture is controlled by the orientation of the minimum horizontal stress in consolidated sediments and brittle rocks.

At shallow depths, the horizontal stresses could be less or greater than the vertical overburden stress. If the horizontal stresses are less than the vertical overburden stress, then vertical fractures will be produced; whereas if the horizontal stresses are greater than the vertical overburden stress, then a horizontal fracture will be formed by the hydraulic fracturing process.

Hydraulic fracturing generally consists of two types, propped and unpropped fracturing. Unpropped fracturing consists of acid fracturing in carbonate formations and water or low viscosity water slick fracturing for enhanced gas production in tight formations. Propped fracturing of low permeable rock formations enhances the formation permeability for ease of extracting petroleum hydrocarbons from the formation. Propped fracturing of high permeable formations is for sand control, i.e. to reduce the inflow of sand into the well bore, by placing a highly permeable propped fracture in the formation and pumping from the fracture thus reducing the pressure gradients and fluid velocities due to draw down of fluids from the well bore. Hydraulic fracturing involves the literally breaking or fracturing the rock by injecting a specialized fluid into the well bore passing through perforations in the casing to the geological formation at pressures sufficient to initiate and/or extend the fracture in the formation. The theory of hydraulic fracturing utilizes linear elasticity and brittle failure theories to explain and quantify the hydraulic fracturing process. Such theories and models are highly developed and generally sufficient for the art of initiating and propagating hydraulic fractures in brittle materials such as rock, but are totally inadequate in the understanding and art of initiating and propagating hydraulic fractures in ductile materials such as unconsolidated sands and weakly cemented formations.

Hydraulic fracturing has evolved into a highly complex process with specialized fluids, equipment and monitoring systems. The fluids used in hydraulic fracturing vary depending on the application and can be water, oil, or multi-phased based gels. Aqueous based fracturing fluids consist of a polymeric gelling agent such as solvatable (or hydratable) polysaccharide, e.g. galactomannan gums, glycomannan gums, and cellulose derivatives. The purpose of the hydratable polysaccharides is to thicken the aqueous solution and thus act as viscosifiers, i.e. increase the viscosity by 100 times or more over the base aqueous solution. A cross-linking agent can be added which further increases the viscosity of the solution. The borate ion has been used extensively as a cross-linking agent for hydrated guar gums and other galactomannans, see U.S. Pat. No. 3,059,909 to Wise. Other suitable cross-linking agents are chromium, iron, aluminum, and zirconium (see U.S. Pat. No. 3,301,723 to Chrisp) and titanium (see U.S. Pat. No. 3,888,312 to Tiner et al). A breaker is added to the solution to controllably degrade the viscous fracturing fluid. Common breakers are enzymes and catalyzed oxidizer breaker systems, with weak organic acids sometimes used.

Oil based fracturing fluids are generally based on a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage, that would otherwise be caused by water based fracturing fluids.

The method of controlling the azimuth of a vertical hydraulic fracture in formations of unconsolidated or weakly cemented soils and sediments by slotting the well bore or installing a pre-slotted or weakened casing at a predetermined azimuth has been disclosed. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. See U.S. Pat. No. 6,216,783 to Hocking et al, U.S. Pat. No. 6,443,227 to Hocking et al, U.S. Pat. No. 6,991,037 to Hocking, U.S. patent application Ser. No. 11/363,540 and U.S. patent application Ser. No. 11/277,308. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. It is now known that unconsolidated or weakly cemented sediments behave substantially different from brittle rocks from which most of the hydraulic fracturing experience is founded.

Accordingly, there is a need for a method and apparatus for enhancing the extraction of hydrocarbons from oil sands by direct heating, steam and/or solvent injection, or a combination thereof and controlling the subsurface environment, both temperature and pressure to optimize the hydrocarbon extraction in terms of produced rate, efficiency, and produced product quality, as well as limit water inflow into the process zone.

SUMMARY OF THE INVENTION

The present invention is a method and apparatus for enhanced recovery of petroleum fluids from the subsurface by convective heating of the oil sand formation and the heavy oil and bitumen in situ, by either a downhole heater in the well bore or heat supplied to the well bore by a heat transferring fluid from a surface fired heater or surface burner. Multiple propped hydraulic fractures are constructed from the well bore into the oil sand formation and filled with a highly permeable proppant. The permeable propped fractures and well bore are filled with a diluent and elevated temperatures from the heater set up thermal convective cells in the diluent forcing heated diluent to flow upward and outward in the propped fractures and circulating back down and back towards the well bore heating the oil sands and in situ bitumen on the vertical faces of the propped fractures. The diluent now mixed with produced products from the oil sand re-enters the bottom of the well bore and passes over the heater element and is reheated to continue to flow in the convective cell. Thus the heating and diluting of the in place bitumen is predominantly circumferential, i.e. orthogonal to the propped fracture, diffusion from the propped vertical fracture faces progressing at a nearly uniform rate into the oil sand deposit. To limit upward growth of the process, a non condensing gas can be injected to remain in the uppermost portions of the propped fractures.

The processes active at the contact of the diluent with the bitumen in the oil sand are predominantly diffusive, being driven by partial pressure gradients and thermal gradients, resulting in the diffusion of diluent components into the bitumen and the conduction of heat from the diluent into the bitumen and oil sand formation. Upon softening of the bitumen, the oil will become mobile and additional smaller convective cells will developed providing better mixing of the diluent in the propped fracture and the every expanded zone of mobile oil in the native oil sand formation.

The diluent would preferably be an on site diluent, light oil, or natural gas condensate stream, or a mixture thereof, with its selected composition to provide a primarily liquid phase of the diluent in the process zone at the imposed reservoir temperatures and pressures. The diluent could be derived from synthetic crude if available. The prime use of the diluent is to transfer by convection, heat from the well bore to the process zone, heat and dilute the produced product to yield a mixture that will flow readily at the elevated temperatures through the oil sands and propped fractures back to the well bore. The selected range of temperatures and pressures to operate the process will depend on reservoir depth, ambient conditions, quality of the in place heavy oil and bitumen, composition of the diluent, and the presence of nearby water bodies. The process can be operated at a low temperature range of ~100° C. for a heavy oil rich oil sand deposit and at a moderate temperature range of ~150°-180° C. for a bitumen rich oil sand deposit, basically to reduce the bitumen viscosity and thus mobilized the in place oil. However, the process can be operated a much higher temperatures >270° C. to pyrolysis the in place hydrocarbon in the presence of hydrogen and/or catalysts. The operating pressure of the process may be selected to closely match the ambient reservoir conditions to minimize water inflow into the process zone and the well bore. However, the process operating conditions may deviate from this pressure in order to maintain the diluent and produced mixture in a predominantly liquid state, i.e. the diluent is to remain in most part soluble in the produced heavy oil or bitumen at the operating process temperatures and pressures.

To accelerate the process, forced convection by a pump can assist and transfer additional heat into the propped fracture convective cells, by pumping the diluent and produced product at greater velocities past the heater and into the propped fractures and mobile zone within the oil sands.

During the heating and diluting process in situ, only a small quantity of the mobile produced product will be extracted from the subsurface in order to maintain reservoir pressures optimum for the process and to maintain a high liquid level in the process zone, thus resulting heat transfer occurring at more or less a uniform rate in a circumferential direction. Drawing down the pressure for petroleum extraction will result in gas release from the mixture filling the upper portion of the process zone as the liquids are extracted from the formation. Upon production of the liquid hydrocarbons the gas in the process zone could be produced by sweeping the process zone with another gas, or the gas could be re-pressurized to reservoir conditions to minimize water inflow into the process zone and the thermal energy in the process zone oil sands allowed to conduct radially into the surrounding cooler oil sands and thus mobilize additional hydrocarbons (i.e. a heat conductive soak) albeit at a much reduced rate than during the active heating phase of the process. Finally the remaining liquid hydrocarbons and gas are produced from the oil sand formation after some extended heat conductive soak period.

The prime benefits of the above process are to provide an efficient low temperature heating phase to mobilize the hydrocarbon in situ, to produce a higher grade petroleum product, and to maintain ambient reservoir pressure conditions and thus limit water inflow into the process zone. The disadvantage of the process is that only minimal quantities of hydrocarbons are extracted from the subsurface during the active heating phase of the process since the majority of the hydrocarbons are produced near the end of the process.

Although the present invention contemplates the formation of fractures which generally extend laterally away from a vertical or near vertical well penetrating an earth formation and in a generally vertical plane, those skilled in the art will recognize that the invention may be carried out in earth formations wherein the fractures and the well bores can extend in directions other than vertical.

Therefore, the present invention provides a method and apparatus for enhanced recovery of petroleum fluids from the subsurface by convective heating of the oil sand formation and the viscous heavy oil and bitumen in situ, more particularly to a method and apparatus to extract a particular fraction of the in situ hydrocarbon reserve by controlling the reservoir temperature and pressure, while also minimizing water inflow into the heated zone and well bore resulting in increased production of petroleum fluids from the subsurface formation.

Other objects, features and advantages of the present invention will become apparent upon reviewing the following description of the preferred embodiments of the invention, when taken in conjunction with the drawings and the claims.

DETAILED DESCRIPTION OF THE DISCLOSED EMBODIMENT

Several embodiments of the present invention are described below and illustrated in the accompanying drawings. The present invention involves a method and apparatus for enhanced recovery of petroleum fluids from the subsurface by convective heating of the oil sand formation and the heavy oil and bitumen in situ, by either a downhole heater in the well bore or heat supplied to the well bore by a heat transferring fluid from a surface fired heater or surface burner. Multiple propped hydraulic fractures are constructed from the well bore into the oil sand formation and filled with a highly permeable proppant. The permeable propped fractures and well bore are filled with a diluent, the heater and pump activated with forced thermal convective flow forcing the heated diluent to flow upward and outward in the propped fractures and circulating back down and back towards the well bore heating the oil sands and in situ bitumen on the vertical faces of the propped fractures. The diluent now mixed with produced products from the oil sand re-enters the bottom of the well bore and passes over the heater element and is reheated to continue to flow in the convective cell. Thus the heating and diluting of the in place bitumen is predominantly circumferentially, i.e. orthogonal to the propped fracture, diffusion from the propped vertical fracture faces progressing at a nearly uniform rate into the oil sand deposit. The heated low viscosity oil is produced through the well bore at the completion of the active heating phase of the process.

Figure 1:
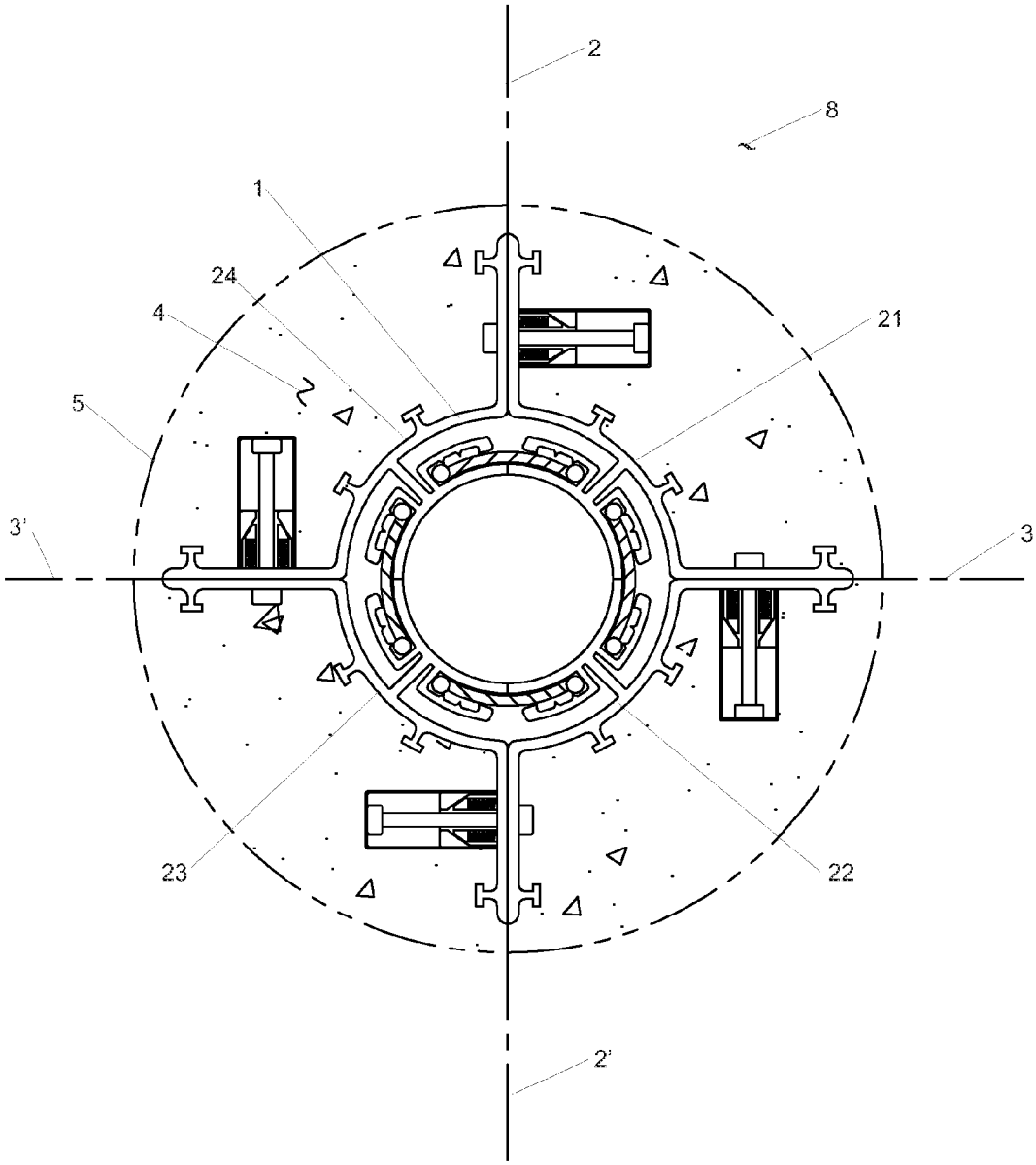
FIG. 1 is a horizontal cross-section view of a well casing having dual fracture winged initiation sections prior to initiation of multiple azimuth controlled vertical fractures.
Figure 2:
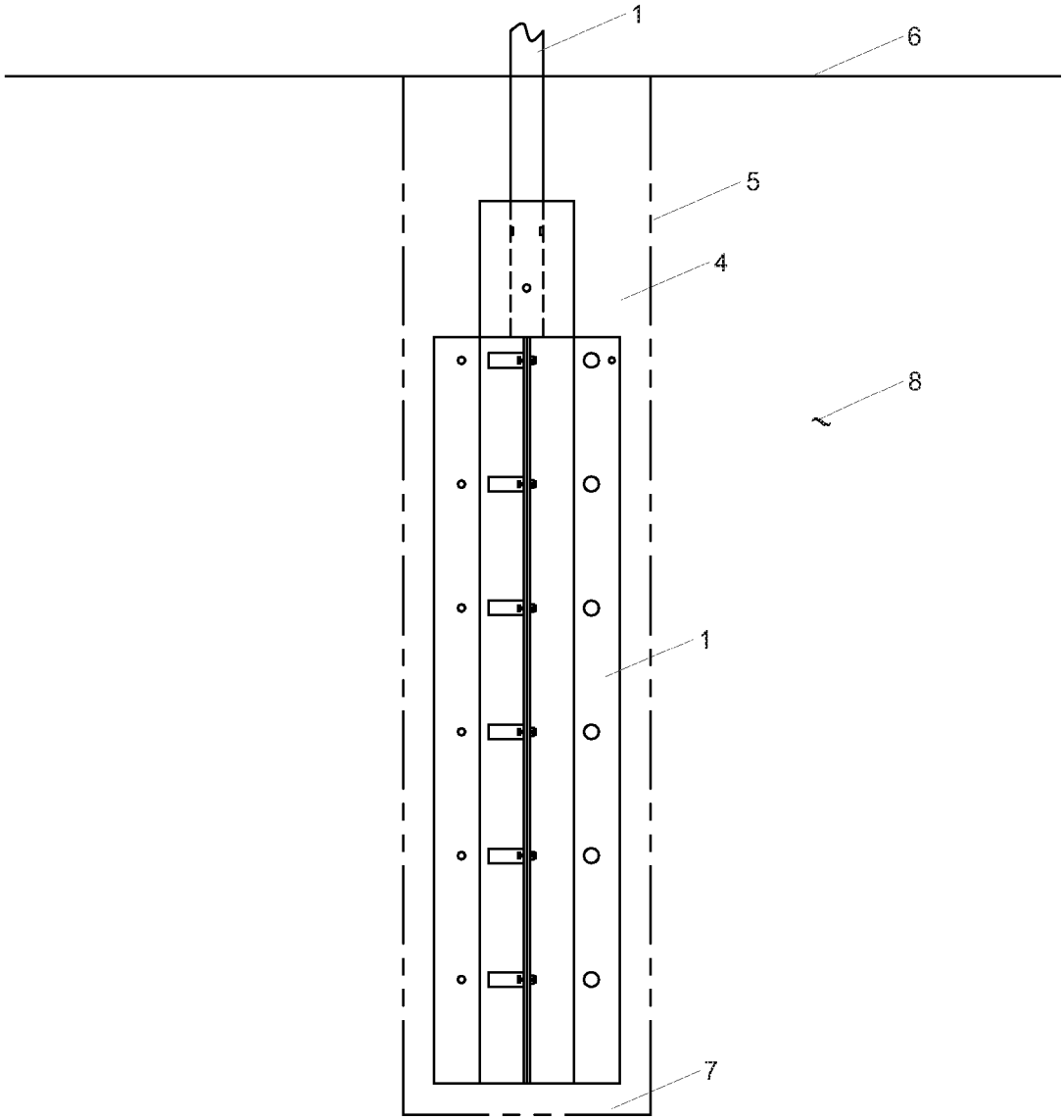
FIG. 2 is a cross-sectional side elevation view of a well casing having dual fracture winged initiation sections prior to initiation of multiple azimuth controlled vertical fractures.
Figure 3:
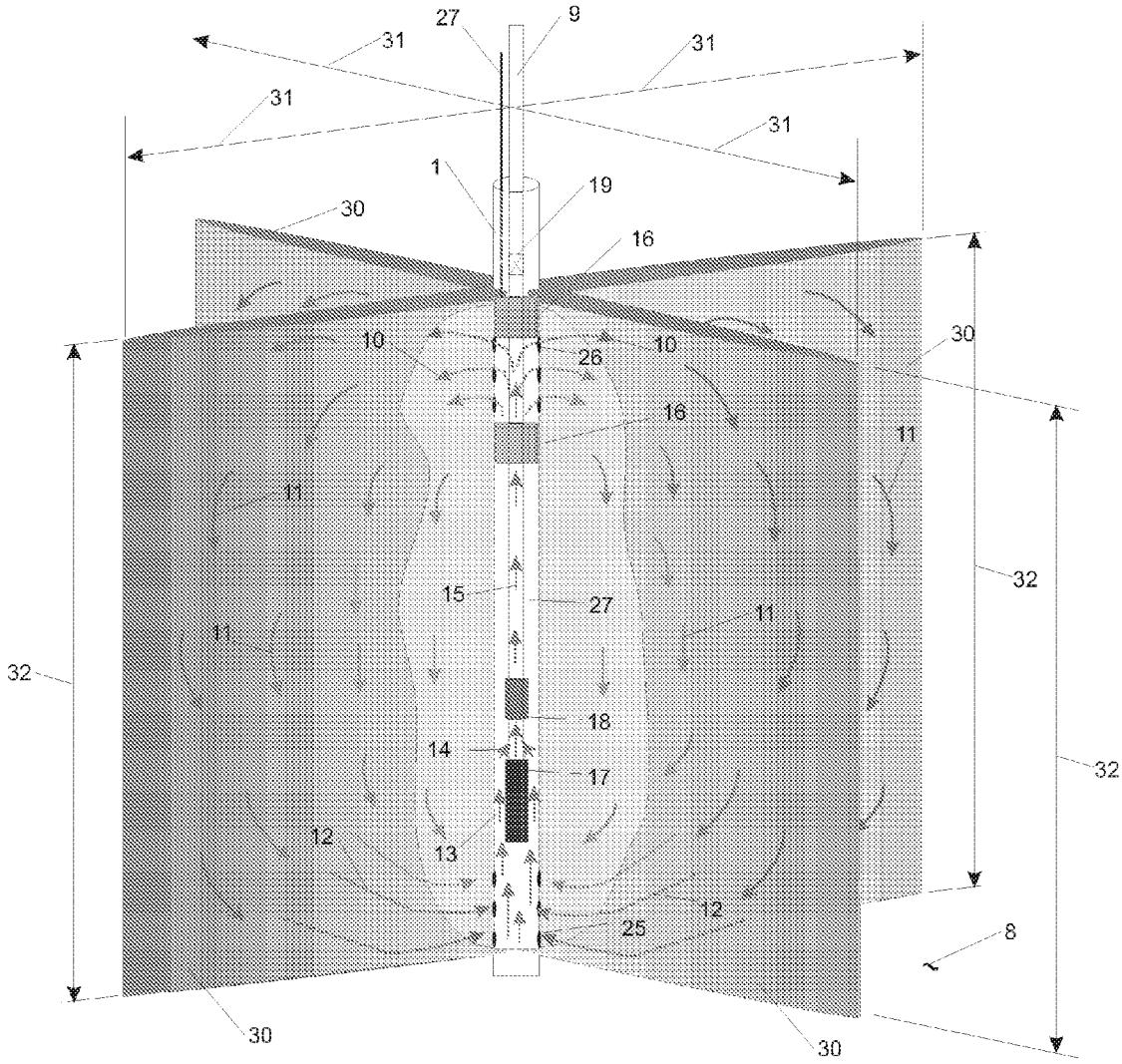
FIG. 3 is an isometric view of a well casing having dual propped fractures with downhole heater and convection fluid flow shown in the subsurface.

Referring to the drawings, in which like numerals indicate like elements, FIGS. 1, 2, and 3 illustrate the initial setup of the method and apparatus for forming an in situ forced convective heating system of the oil sand deposit and for the extraction of the processed hydrocarbons. Conventional bore hole 5 is completed by wash rotary or cable tool methods into the formation 8 to a predetermined depth 7 below the ground surface 6. Injection casing 1 is installed to the predetermined depth 7, and the installation is completed by placement of a grout 4 which completely fills the annular space between the outside the injection casing 1 and the bore hole 5. Injection casing 1 consists of four initiation sections 21, 22, 23, and 24 to produce two fractures one orientated along plane 2, 2' and one orientated along plane 3, 3'. Injection casing 1 must be constructed from a material that can withstand the pressures that the fracture fluid exerts upon the interior of the injection casing 1 during the pressurization of the fracture fluid. The grout 4 can be any conventional material used in steam injection casing cementation systems that preserves the spacing between the exterior of the injection casing 1 and the bore hole 5 throughout the fracturing procedure, preferably a non-shrink or low shrink cement based grout that can withstand high temperature and differential strains.

The outer surface of the injection casing 1 should be roughened or manufactured such that the grout 4 bonds to the injection casing 1 with a minimum strength equal to the down hole pressure required to initiate the controlled vertical fracture. The bond strength of the grout 4 to the outside surface of the casing 1 prevents the pressurized fracture fluid from short circuiting along the casing-to-grout interface up to the ground surface 6.

Referring to FIGS. 1, 2, and 3, the injection casing 1 comprises two fracture dual winged initiation sections 21, 22, 23, and 24 installed at a predetermined depth 7 within the bore hole 5. The winged initiation sections 21, 22, 23, and 24 can be constructed from the same material as the injection casing 1. The position below ground surface of the winged initiation sections 21, 22, 23, and 24 will depend on the required in situ geometry of the induced hydraulic fracture and the reservoir formation properties and recoverable reserves.

The hydraulic fractures will be initiated and propagated by an oil based fracturing fluid consisting of a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage, that would otherwise be caused by water based fracturing fluids. The oil based gel provides the added advantage of placing the required diluent within the propped fracture, without the inherent problems of injecting a diluent into a water saturated proppant fracture if water based fracturing fluids were used.

The pumping rate of the fracturing fluid and the viscosity of the fracturing fluids needs to be controlled to initiate and propagate the fracture in a controlled manner in weakly cemented sediments such as oil sands. The dilation of the casing and grout imposes a dilation of the formation that generates an unloading zone in the oil sand, and such dilation of the formation reduces the pore pressure in the formation in front of the fracturing tip. The variables of interest are v the velocity of the fracturing fluid in the throat of the fracture, i.e. the fracture propagation rate, w the width of the fracture at its throat, being the casing dilation at fracture initiation, and $\mu$ the viscosity of the fracturing fluid at the shear rate in the fracture throat. The Reynolds number is $Re=\rho vw/\mu$. To ensure a repeatable single orientated hydraulic fracture is formed, the formation needs to be dilated orthogonal to the intended fracture plane, the fracturing fluid pumping rate needs to be limited so that the Re is less than 100 during fracture initiation and less than 250 during fracture propagation. Also if the fracturing fluid can flow into the dilated zone in the formation ahead of the fracture and negate the induce pore pressure from formation dilation, then the fracture will not propagate along the intended azimuth. In order to ensure that the fracturing fluid does not negate the pore pressure gradients in front of the fracture tip, its viscosity at fracturing shear rates within the fracture throat of ~1-20 $sec^{-1}$ needs to be greater than 100 centipoise.

The fracture fluid forms a highly permeable hydraulic fracture by placing a proppant in the fracture to create a highly permeable fracture. Such proppants are typically clean sand for large massive hydraulic fracture installations or specialized manufactured particles (generally resin coated sand or ceramic in composition), which are designed also to limit flow back of the proppant from the fracture into the well bore. The fracture fluid-gel-proppant mixture is injected into the formation and carries the proppant to the extremes of the fracture. Upon propagation of the fracture to the required lateral 31 and vertical extent 32 (FIG. 3), the predetermined fracture thickness may need to be increased by utilizing the process of tip screen out or by re-fracturing the already induced fractures. The tip screen out process involves modifying the proppant loading and/or fracture fluid properties to achieve a proppant bridge at the fracture tip. The fracture fluid is further injected after tip screen out, but rather then extending the fracture laterally or vertically, the injected fluid widens, i.e. thickens, and fills the fracture from the fracture tip back to the well bore.

Referring to FIG. 3, the casing 1 is washed clean of fracturing fluids and screens 25 and 26 are present in the casing as a bottom screen 25 and a top screen 26 for hydraulic connection from the casing well bore 1 to the propped fractures 30. A downhole electric heater 17 is placed inside the casing, with a downhole pump 18, connected to a power and instrumentation cable 27, with downhole packers 16 to isolate the top screen interval from the remaining sections of the well bore, piping 27, and downhole valve 19. The heater 17 and pump 18 are energized through electric power provided from the surface through cable 27. The pump and thermal buoyancy effects forces the diluent fluid to flow 13 past the heater into 14 the pump 18 and up 15 the tubing 27 and out of the top screen 26. The downhole valve 19 in the closed position enables the pumped hot fluid to flow through the top screen 26 into the fracture and oil sand formation as flow vectors 10, 11, and 12 illustrating the convection cell formation due to the pumped hot fluid. The surface controlled downhole valve 19 in the open position enables the pump fluid to flow only up the tubing 9 and not into the top screen 26. The fluid diluent is cooled by the oil sands 8 adjacent to the propped fractures 30 as it flows from 10 to 11 to 12, and enters the well bore through the bottom screen 25 to be convectively moved 13 up past the heater 17 for a return to the forced convective re-circulation cell.

Figure 4:
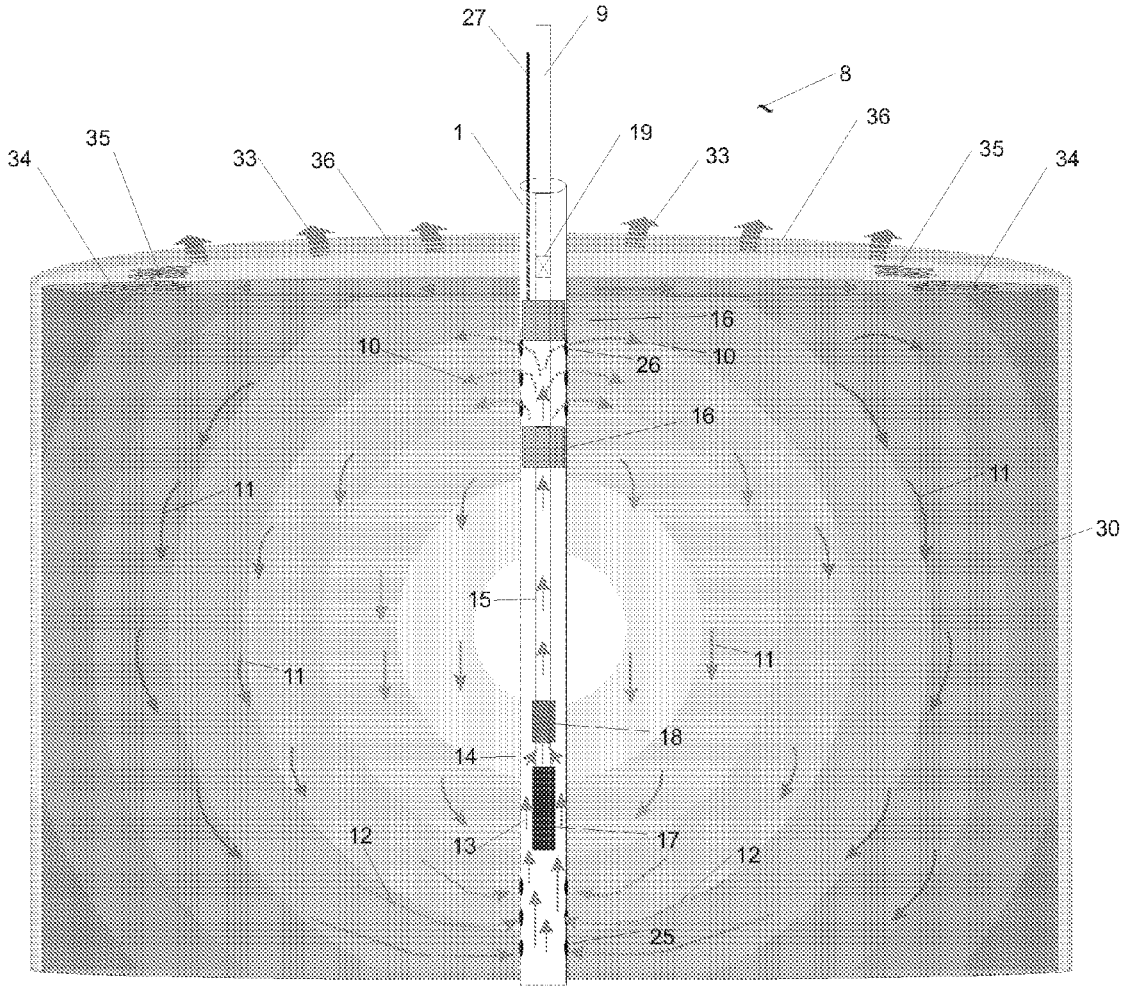
FIG. 4 is a horizontal cross-sectional side elevation view of a well casing and propped fracture with downhole heater and convective fluid flow shown in the subsurface.

Referring to FIGS. 3 and 4, the hot diluent flows in a re-circulation force convective cell as shown by vectors 10, 11, and 12 in the propped fracture 30 with proppant shown 34 and mobilized oil sand zone 35 adjacent to the propped fractures 34. The mobilized oil sand zone extends into the bitumen oil sands 36 by diffusive processes 33 due to partial pressure and temperature gradients. The mixture of diluent and produced bitumen results in a modified hydrocarbon that flows from the bitumen 36 into the mobilized oil sand zone 35 and the propped fracture 34 to flow eventually as 12 into the lower screen 25 of the well bore. The process zone includes the propped hydraulic fractures 30, the mobile zone 35 in the oil sands of the formation, and the fluid contained therein. In some cases, the well bore casing 1 may be considered part of the process zone when a part of the process for recovering hydrocarbons from the formation is carried out in the well casing.

The mobilized oil sand zone 35 grows circumferentially 33, i.e. orthogonal to the propped fractures 30, and becomes larger with time until eventually the bitumen within the lateral 31 and vertical 32 extent of the propped fracture system is completely mobilized by the elevated temperature and diffused diluent. As the mobilized oil sand region 35 grows the diluent fluid 12 entering the lower screen 26 of the well bore becomes a mixture of mobilized oil from the bitumen and the original diluent. It may be necessary to dilute this mixture from time to time with additional diluent to yield the required viscosity and heat transfer properties of the heated fluid in the re-circulation cell. Upon growth of the mobilized oil sand zone to the lateral 31 and vertical 32 extents of the propped fractures 30, the valve 19 will be open and the liquid hydrocarbons produced up the tubing 9 to the surface.

As the pressure is lowered during hydrocarbon production to the surface, gases from the diluent and bitumen mixture will fill the mobilized oil sand region 35 and the propped fractures 34. Re-pressurizing these gases back to ambient reservoir pressures will minimize water inflow into the heated region and an extended heat conduction soak can provide additional mobilized hydrocarbons from the oil sands with out additional heat required. Alternatively, the process zone can be injected with a vaporized hydrocarbon solvent, such as ethane, propane, or butane and mixed with a diluent gas, such as methane, nitrogen, and carbon dioxide. The solvent will contact the in situ bitumen at the edge of the process zone, diffusive into and soften the bitumen, so that it flows by gravity to the well bore. Dissolved solvent and product hydrocarbon are produced and further solvent and diluent gas injected into the process zone. The elevated temperature of the process zone will significantly accelerate the diffusion process of the solvent diffusing into the bitumen compared to ambient reservoir conditions. The solvent and diluent gas will be injected at near reservoir pressures to minimize water inflow into the process zone. The solvent vapor in the injection gas is maintained saturated at or near its dew point at the process operating temperatures and pressures.

During the active heating phase of the process, the reservoir temperatures and pressures and composition of the produced fluid will be controlled to optimize the process as regards the quality and composition of the produced product, the heat transfer, and diluent properties of the produced mixture, and to minimize water inflow into the process zone and well bore.

Figure 5:
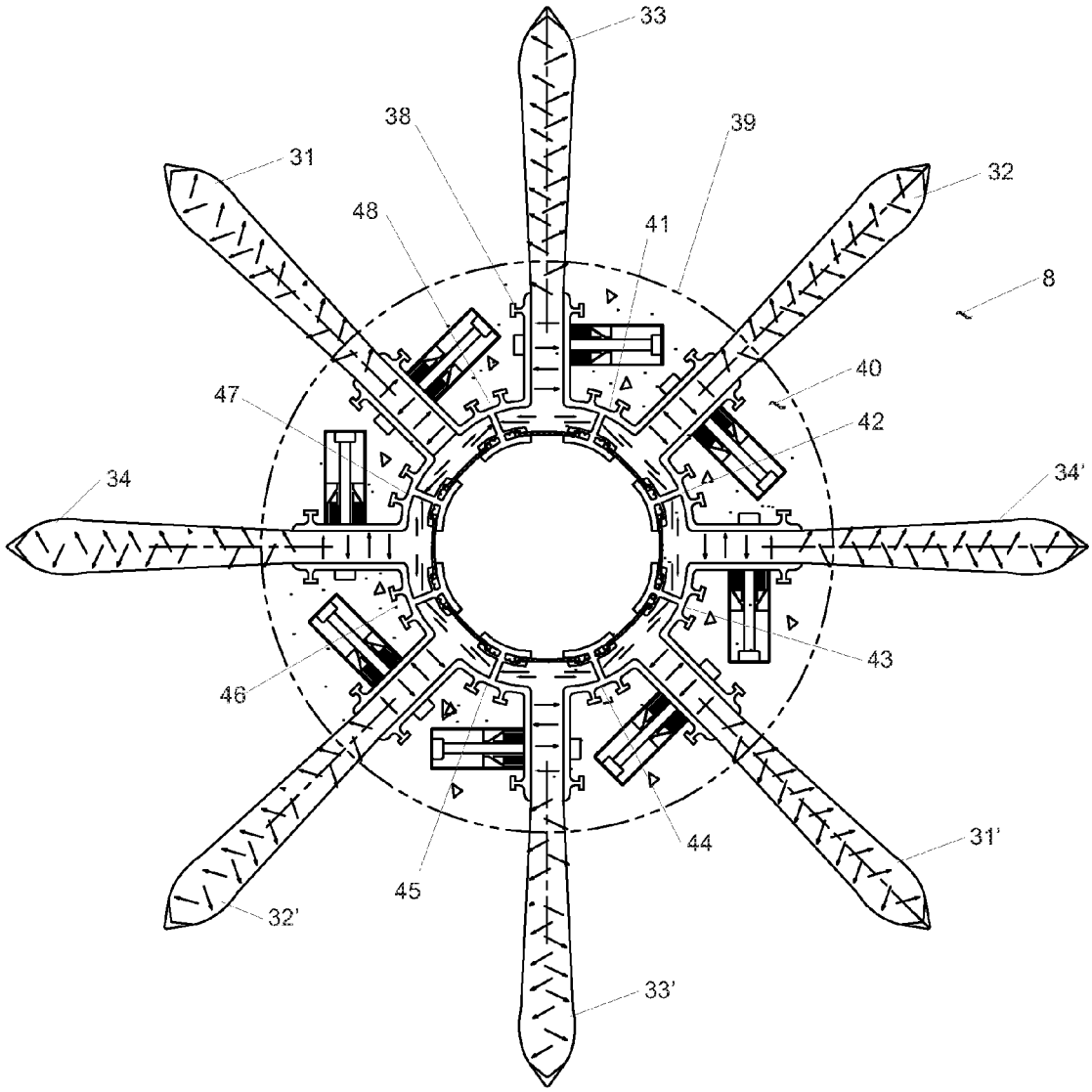
FIG. 5 is a horizontal cross-section view of a well casing having multiple fracture dual winged initiation sections after initiation of all four controlled vertical fractures.
Figure 6:
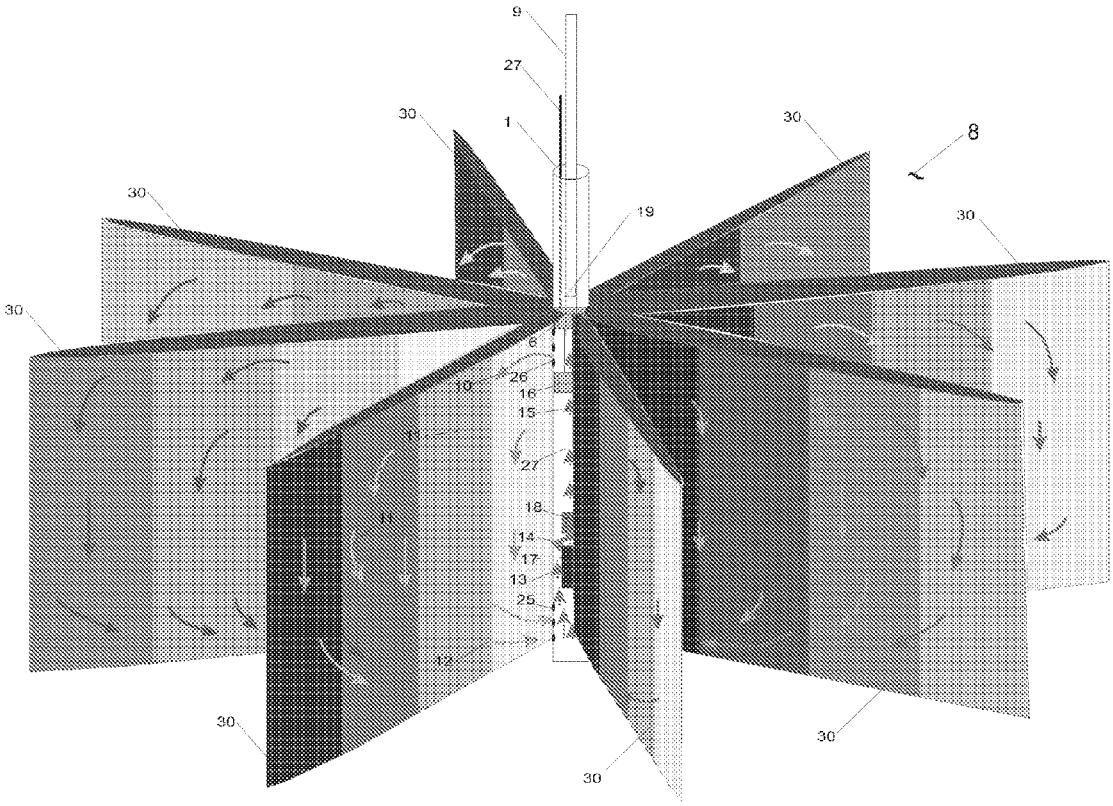
FIG. 6 is an isometric view of a well casing having four propped fractures with downhole heater and convection fluid flow shown in the subsurface.

Another embodiment of the present invention is shown on FIGS. 5 and 6, consisting of an injection casing 38 inserted in a bore hole 39 and grouted in place by a grout 40. The injection casing 38 consists of eight symmetrical fracture initiation sections 41, 42, 43, 44, 45, 46, 47, and 48 to install a total of four hydraulic fractures on the different azimuth planes 31, 31', 32, 32', 33, 33', 34, and 34'. The process results in four hydraulic fractures installed from a single well bore at different azimuths as shown on FIG. 6. The casing 1 is washed clean of fracturing fluids and screens 25 and 26 are present in the casing as a bottom screen 25 and a top screen 26 for hydraulic connection of the well bore 10 to the propped fractures 30. A downhole electric heater 17 is placed inside the casing, with a downhole pump 18, connected to a power and instrumentation cable 27, with downhole packers 16 to isolate the top screen interval from the remaining sections of the well bore, piping 27, and downhole valve 19. The heater 17 and pump 18 are energized through electric power provided from the surface through cable 27. The pump and thermal buoyancy effects force the diluent fluid to flow 13 past the heater into 14 the pump 18 and up 15 the tubing 27 and out of the top screen 26. The downhole valve 19 in the closed position enables the pumped hot fluid to flow through the top screen 26 into the fracture and oil sand formation as flow vectors 10, 11, and 12 illustrating the convection cell formation due to the pumped hot fluid. The fluid diluent is cooled by the oil sands 8 adjacent to the propped fractures 30 as it flows from 10 to 11 to 12, and enters the well bore through the bottom screen 25 to be convectively moved 13 up past the heater 17 for a return to the forced convective re-circulation cell. Following the active heater phase of the process, the mobilized hydrocarbons are produced from the well bore and heated zone through opening the downhole valve 19 and transported by tubing 9 to the surface.

Figure 7:
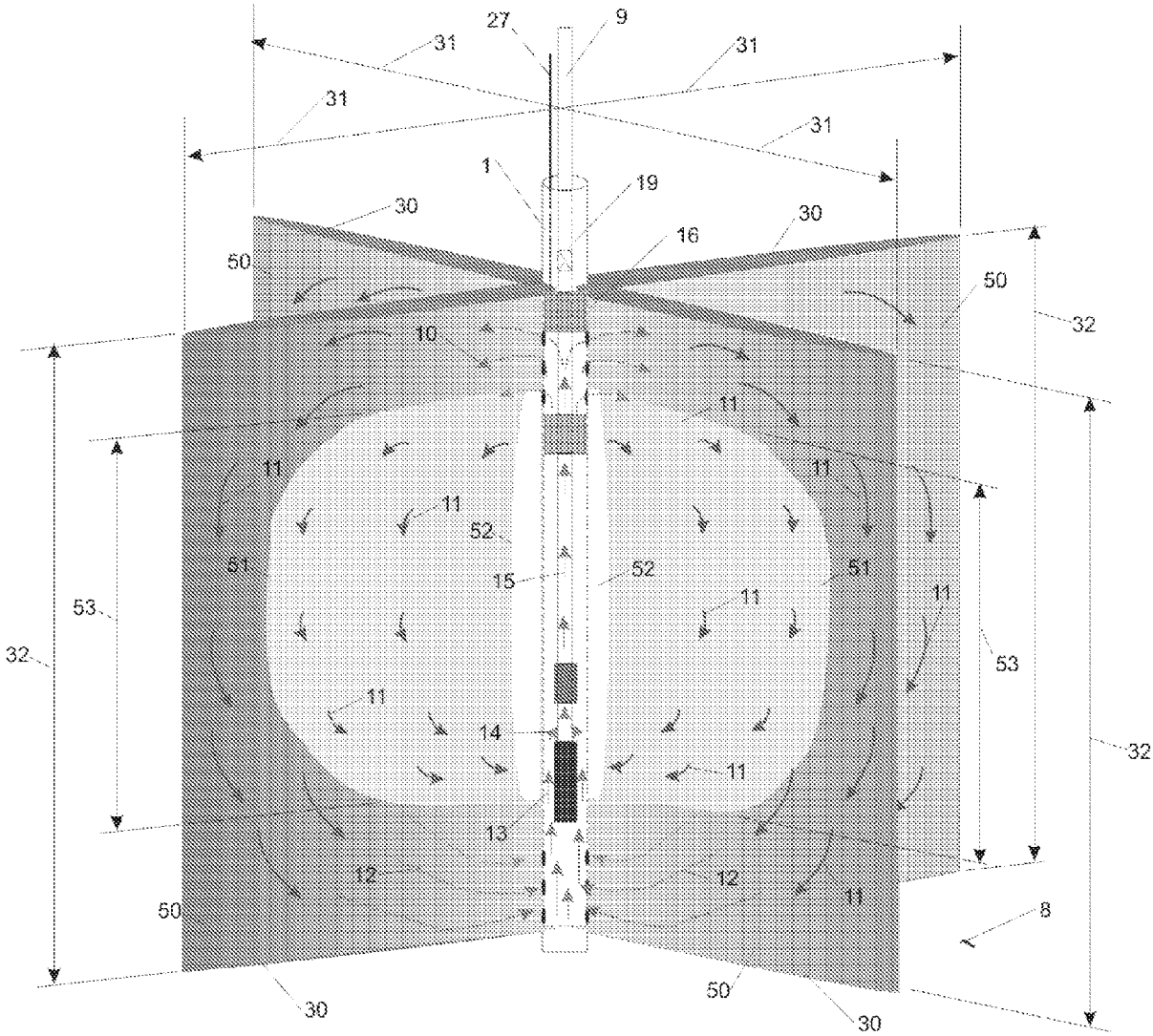
FIG. 7 is an isometric view of a well casing having dual multi-stage propped fractures with downhole heater and convection fluid flow shown in the subsurface.

Another embodiment of the present invention is shown on FIG. 7, similar to FIG. 3 except that the hydraulic fractures are constructed by a multi-stage process with various proppant materials of differing permeability. Multi-stage fracturing involves first injecting a proppant material 50 to form a hydraulic fracture 30. Prior to creation of the full fracture extent, a different proppant material 51 is injected into the fracture over a reduced central section of the well bore 53 to create an area of the hydraulic fracture loaded with the different proppant material 51. Similarly, the multi-stage fracturing could consist of a third stage by injecting a third different proppant material 52. By the appropriate selection of proppants with differing permeability, the circulation of the diluent and mobilized oil in the formed fracture can be extended laterally a greater distance compared to a hydraulic fracture filled with a uniform permeable proppant, as shown earlier in FIG. 3. The proppant materials are selected so that the proppant material 50 has the highest proppant permeability, with proppant material 51 being lower, and with proppant material 52 having the lowest proppant permeability. The different permeability of the proppant materials thus optimizes the lateral extent of the fluids flowing within the hydraulic fractures and controls the geometry and propagation rate of the convective heat to the oil sand formation. The permeability of the proppant materials will typically range from 1 to 100 Darcy for the proppant material 50 in the fracture zone, i.e. generally being at least 10 times greater than the oil sand formation permeability. The proppant material 51 in fracture zone is selected to be lower than the proppant material 50 in the fracture zone by at least a factor of 2, and proppant material 52 in the fracture zone close to the well bore casing 1 is selected to be in the milli-Darcy range thus limiting fluid flow in the fracture zone containing the proppant material 52.

Finally, it will be understood that the preferred embodiment has been disclosed by way of example, and that other modifications may occur to those skilled in the art without departing from the scope and spirit of the appended claims.

What is claimed is:

1. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain a proppant and a diluent;

c. washing fracturing fluids from the casing;

d. providing heat inside the casing from a heat source to raise the temperature in a section of the bore hole containing the diluent;

e. providing a downhole pump and piping inside the casing;

f. providing a top screen and a bottom screen in said casing hydraulically connecting said well bore to said hydraulic fractures;

g. circulating the diluent past said heat source, into the downhole pump, through the piping and out of the casing through the top screen and into the hydraulic fractures and the formation and from the hydraulic fractures and the formation into the casing through the bottom screen; and h. recovering a mixture of diluent and hydrocarbons from the formation.

2. The method of claim 1, wherein the heat is provided by a downhole heater.

3. The method of claim 2, wherein the heat is provided by a downhole electric heater.

4. The method of claim 2, wherein the heat is provided by a downhole flameless distributed combustor.

5. The method of claim 1, wherein a downhole pump provides forced convective circulation of the diluent and hydrocarbons mixture.

6. The method of claim 1, wherein the temperature in part of the formation is in the order of 100° C. to cause hydrocarbons comprising heavy oil to flow under gravity to the well bore.

7. The method of claim 1, wherein the temperature in part of the formation is in the range of 150° to 200° C. to cause hydrocarbons comprising bitumen to flow under gravity to the well bore.

8. The method of claim 1, wherein the temperature in part of the formation is in a pyrolysis temperature regime of greater than 250° C.

9. The method of claim 1, further comprising controlling the temperature and pressure in the majority of the part of the process zone, wherein the temperature is controlled as a function of pressure, or the pressure is controlled as a function of temperature.

10. The method of claim 1, wherein the diluent and hydrocarbon mixture is predominantly in a liquid phase throughout the process zone.

11. The method of claim 1, wherein the pressure in the majority of the part of the process zone is at ambient reservoir pressure.

12. The method of claim 1, wherein the hydraulic fractures are filled with proppants of differing permeability.

13. The method of claim 1, wherein the formation includes a mobile zone and wherein circulating the diluent causes the heat to transfer predominantly by convection in the mobile zone and to transfer predominantly from the mobile zone to the formation substantially by conduction.

14. The method of claim 1, wherein the method further includes injecting a hydrogenising gas into the well casing and thus into the fluids in the process zone to promote hydrogenation and thermal cracking of at least a portion of the hydrocarbons in the process zone.

15. The method of claim 14, wherein the hydrogenising gas consists of one of the group of $H_2$ and CO or a mixture thereof.

16. The method of claim 14, wherein the method further includes catalyzing the hydrogenation and thermal cracking of at least a portion of the hydrocarbons in the process zone.

17. The method of claim 16, wherein a metal-containing catalyst is used to catalyze the hydrogenation and thermal cracking reactions.

18. The method of claim 16, wherein the catalyst is contained in a canister in the well casing.

19. The method of claim 1, wherein the proppant in the hydraulic fractures contains the catalyst for the hydrogenation and thermal cracking reactions.

20. The method of claim 1, wherein the diluent is selected from the group consisting of: a light oil, a pipeline diluent, natural condensate stream, or a fraction of a synthetic crude or a mixture thereof.

21. The method of claim 1, wherein additional quantities of diluent are injected over time into the well bore to modify the composition of the diluent and hydrocarbons mixture within the process zone.

22. The method of claim 1, wherein a light non-condensing low hydrocarbon solubility gas is injected to fill the uppermost portion of the hydraulic fractures to inhibit upward growth of the process zone.

23. The method of claim 1, wherein the heat source is removed and the hydrocarbons are produced from the formation and a hydrocarbon solvent is injected into the process zone in a vaporized state.

24. The method of claim 23, wherein the solvent is selected from the group consisting of: ethane, propane, butane or a mixture thereof.

25. The method of claim 23, wherein the solvent is mixed with a diluent gas.

26. The method of claim 25, wherein the diluent gas is non-condensable under process conditions in the process zone.

27. The method of claim 25, wherein the non-condensable diluent gas has a lower solubility in the hydrocarbons in the formation than the saturated hydrocarbon solvent.

28. The method of claim 25, wherein the diluent gas is selected from the group consisting of: methane, nitrogen, carbon dioxide, natural gas, or a mixture thereof.

29. The method of claim 1, wherein at least two vertical fractures are installed from the bore hole at approximately orthogonal directions.

30. The method of claim 1, wherein at least three vertical fractures are installed from the bore hole.

31. The method of claim 1, wherein at least four vertical fractures are installed from the bore hole.

32. A hydrocarbon production well in a formation of unconsolidated and weakly cemented sediments, comprising:

a. a bore hole in the formation to a predetermined depth;

b. an injection casing grouted in the bore hole at the predetermined depth, the injection casing including multiple initiation sections separated by a weakening line and multiple passages within the initiation sections and communicating across the weakening line for the introduction of a fracture fluid;

c. a source for delivering the fracture fluid into the injection casing with sufficient fracturing pressure to dilate the formation and initiate a vertical fracture at an azimuth orthogonal to the direction of dilation to create a process zone within the formation, for controlling the propagation rate of each individual opposing wing of the hydraulic fracture, and for controlling the flow rate of the fracture fluid and its viscosity so that the Reynolds Number Re is less than 100 at fracture initiation and less than 250 during fracture propagation and the fracture fluid viscosity is greater than 100 centipoise at the fracture tip;

d. a source for delivering a diluent in the casing above the elevation of the highest hydraulic fracture;

e. a heat source positioned within the casing and in contact with the diluent for heating the diluent;

f. circulating the diluent in a process zone including the hydraulic fractures and the formation; and g. recovering a mixture of diluent and hydrocarbons from the formation through the casing.

33. The well of claim 32, wherein the heat source is a downhole heater.

34. The well of claim 32, wherein the heat source is a downhole electric heater.

35. The well of claim 32, wherein the heat source is a downhole flameless distributed combustor.

36. The well of claim 32, wherein the heat source is a surface fired heater or burner and tubing containing a heat transfer fluid.

37. The well of claim 32, wherein a downhole pump provides forced convective flow of the diluent and hydrocarbons mixture.

38. The well of claim 32, wherein the heat source produces a temperature in part of the formation that is in the order of 100° C. for the hydrocarbons comprising heavy oil thereby causing the heavy oil to flow under gravity to the well bore.

39. The well of claim 32, wherein the heat source produces a temperature in part of the formation that is in the range of 150° to 200° C. for the hydrocarbons comprising bitumen to cause the bitumen to flow under gravity to the well bore.

40. The well of claim 32, wherein the heat source produces a temperature in part of the formation that is in a pyrolysis temperature regime of greater than 250° C.

41. The well of claim 32, further comprising a temperature and pressure regulator that controls the temperature and pressure in a majority of a part of the process zone, wherein the temperature is controlled as a function of pressure, or the pressure is controlled as a function of temperature.

42. The well of claim 32, wherein the diluent and hydrocarbons mixture is predominantly in the liquid phase throughout the process zone.

43. The well of claim 32, wherein the pressure in the majority of the part of the process zone is at ambient reservoir pressure.

44. The well of claim 32, wherein the hydraulic fractures are filled with proppants of differing permeability.

45. The well of claim 32, wherein the formation includes a mobile zone and wherein heat produced by the heat source transfers predominantly by convection in the mobile zone and transfer predominately from the mobile zone to the formation by conduction.

46. The well of claim 32, wherein the well includes means for injecting a hydrogenising gas into the well casing and thus into the fluids in the process zone to promote hydrogenation and thermal cracking of at least a portion of the hydrocarbons in the process zone.

47. The well of claim 32, wherein the hydrogenising gas consists of one of the group of $H_2$ and CO or a mixture thereof.

48. The well of claim 47, wherein the well includes means for catalyzing the hydrogenation and thermal cracking of at least a portion of the hydrocarbons in the process zone.

49. The well of claim 48, wherein a metal-containing catalyst is used to catalyze the hydrogenation and thermal cracking reactions.

50. The well of claim 49, wherein well casing includes a canister containing the catalyst for the hydrogenation and thermal cracking reactions.

51. The well of claim 32, wherein the proppant in the hydraulic fractures contains the catalyst for the hydrogenation and thermal cracking reactions.

52. The well of claim 32, wherein the diluent is a light oil, pipeline diluent, natural condensate stream, or fraction of a synthetic crude or a mixture thereof.

53. The well of claim 32, wherein the well includes means for injecting additional quantities of diluent over time into the well casing to modify the composition of the diluent and hydrocarbons mixture within the process zone.

54. The well of claim 32, wherein the well includes means for injecting a light non-condensing low hydrocarbon solubility gas to fill the uppermost portion of the hydraulic fractures to inhibit upward growth of the process zone.

55. The well of claim 32, wherein the heat source is removed and the hydrocarbons are produced from the formation and a hydrocarbon solvent is injected into the process zone in a vaporized state.

56. The well of claim 55, wherein the solvent is one of a group of ethane, propane, butane, or a mixture thereof.

57. The well of claim 55, wherein the solvent is mixed with a diluent gas.

58. The well of claim 55, wherein the diluent gas is non-condensable under process conditions in the process zone.

59. The well of claim 58, wherein the non-condensable diluent gas has a lower solubility in the hydrocarbons in the formation than the saturated hydrocarbon solvent.

60. The well of claim 59, wherein the diluent gas is one of a group of methane, nitrogen, carbon dioxide, natural gas, or a mixture thereof.

61. The well of claim 32, wherein the well includes at least two vertical fractures installed from the bore hole at approximately orthogonal directions.

62. The well of claim 32, wherein the well includes at least three vertical fractures installed from the bore hole.

63. The well of claim 32, wherein the well includes at least four vertical fractures installed from the bore hole.

64. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain proppants of differing permeability and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation.

65. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen;

g. recovering a mixture of diluent and hydrocarbons from the formation;

h. injecting a hydrogenising gas into the well casing and thus into the fluids in the process zone to promote hydrogenation and thermal cracking of at least a portion of the hydrocarbons in the process zone; and i. catalyzing the hydrogenation and thermal cracking of at least a portion of the hydrocarbons in the process zone, wherein the catalyst is contained in a canister in the well casing.

66. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation, wherein a light non-condensing low hydrocarbon solubility gas is injected to fill the uppermost portion of the hydraulic fractures to inhibit upward growth of the process zone.

67. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation, wherein the heat source is removed and the hydrocarbons are produced from the formation and a hydrocarbon solvent is injected into the process zone in a vaporized state, and wherein the solvent is selected from the group consisting of: ethane, propane, butane or a mixture thereof.

68. A method for in situ recovery of hydrocarbons from a hydrocarbon containing formation, comprising:

a. drilling a bore hole in the formation to a predetermined depth to define a well bore with a casing;

b. installing one or more vertical hydraulic fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation, wherein the heat source is removed and the hydrocarbons are produced from the formation and a hydrocarbon solvent is injected into the process zone in a vaporized state, wherein the solvent is mixed with a diluent gas.

69. The method of claim 68, wherein the diluent gas is non-condensable under process conditions in the process zone.

70. The method of claim 68, wherein the non-condensable diluent gas has a lower solubility in the hydrocarbons in the formation than the saturated hydrocarbon solvent.

71. The method of claim 68, wherein the diluent gas is selected from the group consisting of: methane, nitrogen, carbon dioxide, natural gas, or a mixture thereof.

72. A method for in situ recovery of hydrocarbons from a hydrocarbon containing formation, comprising:

a. drilling a bore hole in the formation to a predetermined depth to define a well bore with a casing;

b. installing at least three vertical fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation.

73. A method for in situ recovery of hydrocarbons from a hydrocarbon containing formation, comprising:

a. drilling a bore hole in the formation to a predetermined depth to define a well bore with a casing;

b. installing at least four vertical fractures from the bore hole to create a process zone by injecting a fracture fluid into the casing, wherein the hydraulic fractures contain a proppant and a diluent;

c. providing heat from a heat source to raise the temperature in a section of the bore hole containing the diluent;

d. providing a downhole pump and piping inside the casing;

e. providing a top screen and a bottom screen in said casing hydraulically connecting said well bore to said hydraulic fractures;

f. circulating the diluent past said heat source, into the downhole pump, through the piping and out of the casing through the top screen and into the hydraulic fractures and the formation and from the hydraulic fractures and the formation into the casing through the bottom screen; and g. recovering a mixture of diluent and hydrocarbons from the formation.

* * * * *